United States Patent [19]

Porter

[11] Patent Number: 4,575,981

[45] Date of Patent: Mar. 18, 1986

[54] ROOF PANEL CONSTRUCTION

[76] Inventor: William H. Porter, P.O. Box 249, Saugatuck, Mich. 49453

[21] Appl. No.: 579,681

[22] Filed: Feb. 13, 1984

[51] Int. Cl.[4] ..... C04D 1/00

[52] U.S. Cl. ..... 52/309.9; 52/539; 52/588

[58] Field of Search ..... 52/539, 540, 541, 409, 52/309.9, 309.11, 588, 592

[56] References Cited

U.S. PATENT DOCUMENTS

| | | | |
|---|---|---|---|
| 2,962,323 | 11/1960 | McBride | 52/309.11 |
| 3,313,073 | 4/1967 | Mathews | 52/309.11 |
| 3,667,180 | 6/1972 | Tischuk | 52/309.9 |
| 3,789,556 | 2/1974 | Skinner | 52/539 |
| 4,037,377 | 7/1977 | Howell | 52/592 |
| 4,100,710 | 7/1978 | Kowallik | 52/309.9 |
| 4,104,840 | 8/1978 | Heintz | 52/309.9 |
| 4,435,934 | 3/1984 | Kim | 52/309.9 |

*Primary Examiner*—Henry E. Raduazo
*Attorney, Agent, or Firm*—Emrich & Dithmar

[57] ABSTRACT

A roof panel includes opposing edges having complementary tongue-in-groove configurations to provide a modified ship-lap joint with an overlapping face between adjacent, abutting roof panels. The panels are used on pitched roofs with the inter-panel joint normally running horizontally. The lower edge of a first panel positioned higher on the roof is provided with a rabbet and an extended portion running the length of the panel. The rabbet includes a groove extending the length thereof and into which a sealant rod or a caulk strip may be inserted. The abutting edge of a second, immediately adjacent lower panel is similarly provided with a complementary rabbet and extended portion for insertion in the first panel's rabbet. Self-tapping screws positioned along the length of the joint are inserted from beneath through the second panel's lower, thin edge, the first panel's extended portion, and then through the second panel's extended portion. Tightening of the screws draws the second panel's extended portion into tight-fitting engagement with the compressive sealant material and allows for the expansion and contraction of the inner and outer faces of the panels and provides a water-tight mechanical seal of increased strength and reduces the possibility of joint opening due to excessive heat or fire in providing improved fire containment.

9 Claims, 3 Drawing Figures

ROOF PANEL CONSTRUCTION

BACKGROUND OF THE INVENTION

This invention relates generally to roof structures and is particularly directed to an interlocking roof panel arrangement employing semi-through fasteners inserted from the underside of the roof.

In general, panel roofs include couplers for joining adjacent panels so as to provide a leak proof, mechanically strong joint. Panel couplers are designed to fill the inter-panel space so as to prevent leakage between adjacent panels while maintaining roof structural integrity. Examples of such panel couplers may be found in U.S. Pat. Nos. 1,295,538 to Lovely, 3,082,848 to Keller, and 3,102,612 to Dunnington. In the past these couplers have generally been overly complicated in structure and have required somewhat involved procedure for installation. These couplers are also generally affixed to adjacent, abutting roof panels by means of either screws or are wedged between adjacent panels in tight fitting relation and make use of one or more compressible sealant elements positioned on the outer surface to provide waterproofing. Without the use of some attachment means such as screws or rivets, the coupler has a tendency to become dislodged from tight engagement between adjacent panels due to various factors such as the temperature-dependent expansion and contraction of adjacent panels. Therefore, in order to provide a more secure mounting arrangment, the coupler has frequently been provided with a connecting pin, such as a screw or a rivet, in its outer surface. However, this arrangement is undesirable because while the coupler-panel interface may be securely sealed, the aperture required for the aforementioned mounting pin provides an additional potential source of leakage. Examples of this type of panel joint coupler may be found in U.S. Pat. Nos. 1,416,888 to Schumacher, 3,282,005 to Birdwell, 3,290,845 to Snyder, 3,791,088 to Sandow et al., 4,068,437 to Byxbe et al., and French Pat. No. 1,041,751 to Twerenbold. U.S. Pat. No. 3,886,699 to Bergmann discloses a portable building structure in which a connecting device is not positioned between adjacent panels but rather tap holes are provided through the lower surface of an upper panel through which machine bolts are inserted for engaging an upper edge portion of the next lower, adjacent panel. While apparently providing a water sealant capability, this arrangement does not securely couple adjacent panels and thus is of limited strength.

The present invention addresses the aforementioned problems of the prior art by providing an interlocking roof panel arrangement in which fasteners, or connecting pins, are inserted from the underside of the roof in order to securely draw together overlapping portions of abutting roof panels.

OBJECTS AND SUMMARY OF THE INVENTION

Accordingly, it is an object of the present invention to provide an improved interlocking roof panel arrangement.

It is another object of the present invention to provide a leak-proof roof panel seal which is easily installed and inexpensive.

Yet another object of the present invention is to provide an improved water seal and high strength mechanical coupling between abutting roof panels.

A further object of the present invention is to provide a panel roof construction having a waterproof seal which is inexpensive, easily installed, of high mechanical strength and easily adapted for a wide range of applications and environments.

These and other objects are achieved by the present invention which contemplates interlocking roof panels of sandwich-type construction having a central layer or core of rigid plastic foam and outer surfaces of sheet metal, such as of aluminum or steel. The panels are used in pitched roofs with the inter-panel joint normally running horizontally. The joint is formed of facing lateral edges of abutting panels, with each edge including a grooved portion for receiving a complementary extended portion of the next adjacent panel. The higher panel includes an extended lip on its upper surface which overlaps the next lower adjacent panel. The extended lip includes a linear, recessed pocket running the length of the panel into which a sealant rod or caulk strip may be positioned for engaging an upper surface of the next lower panel in forming a water-tight seal. A plurality of screws are inserted from the underside of the roof along the length of the inter-panel joint so as to engage and draw together the overlapped edge portions of abutting panels to provide an inter-panel joint of high strength having a minimum number of components.

BRIEF DESCRIPTION OF THE DRAWINGS

The appended claims set forth those novel features believed characteristic of the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DESCRIPTION OF THE PREFERRED EMBODIMENT

Figure 1:
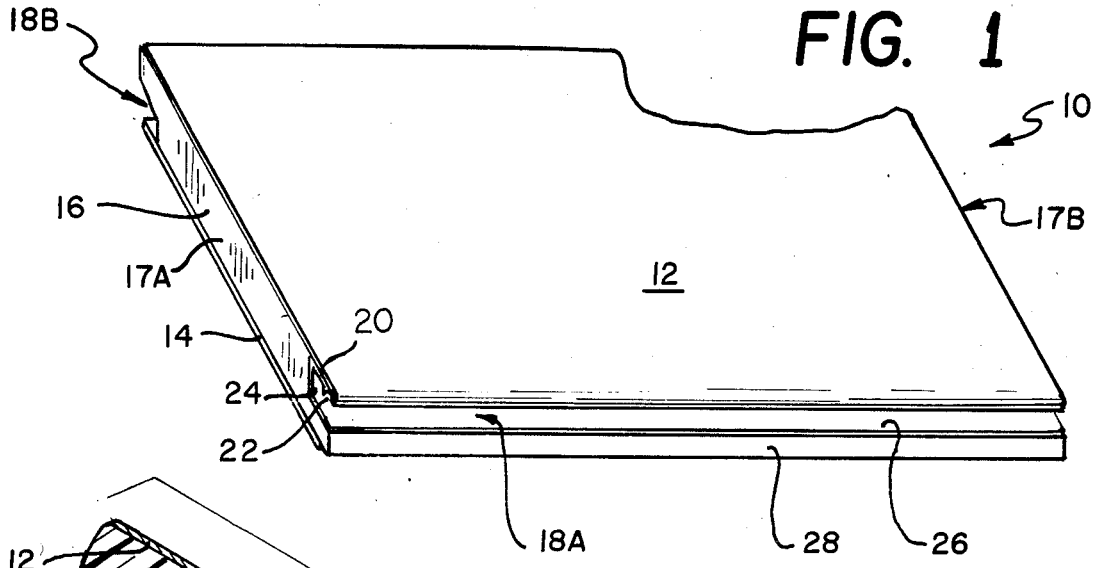
FIG. 1 is a perspective view of a roof panel in accordance with a preferred embodiment of the present invention.

Referring to FIG. 1, there is shown a perspective view of a roof panel 10 in accordance with the present inventiCon.

Roof panel 10 includes parallel upper and lower walls 12, 14. The upper, or outer, wall 12 may be of aluminum or steel and forms the roof membrane in the final assembly. The inner wall 14 may also be metal, but may also equally as well be wood or vinyl for decorative purposes. Located between the upper and lower walls 12, 14 is a rigid plastic foam core 16 which, in addition to its structural properties, also possesses heat insulating properties. The lateral edges 17A, 17B of the roof panel 10 are generally flat so as to abut in a flush manner an adjacent roof panel.

Roof panel 10 is generally designed for use in an inclined roof with the opposing edges containing the front and rear slots 18A, 18B aligned horizontally. Roof panel 10 is oriented such that its front slot 18A is lower in the roof structure than its rear slot 18B. Immediately adjacent, identical roof panels are positioned in abutting contact with the edges of roof panel 10 in the roof structure.

The forward, lower and rear, upper edges of the roof panel 10 include respective front and rear slots, or rabbets, 18A, 18B. The front slot 18A is defined by an upper extended edge 20 of the roof panel, a recessed facing surface 24, and an oblique surface 26. In addition, the front edge of the roof panel 10 includes an extended facing surface 28 positioned immediately below the front slot 18A. A distal portion of the upper extended edge 20 includes a sealant groove, or pocket, 22 extending the length of the groove panel and positioned immediately adjacent the edge thereof. From FIG. 1, it can be seen that the complementary shaped forward and aft edges of roof panel 10 permit two of these roof panels to be positioned immediately adjacent one another in an abutting manner such that the forward and rear edges thereof are arranged in an overlapping manner.

Figure 2:
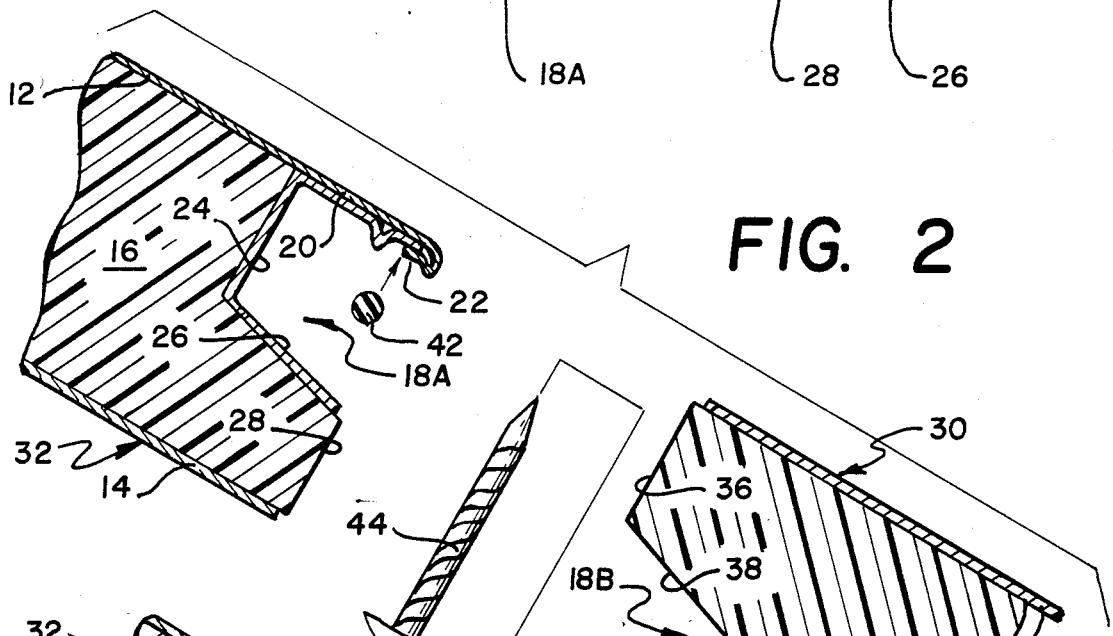
FIG. 2 is an end-on view of the interlocking edge portions of adjacent roof panels in accordance with the present invention.
Figure 3:
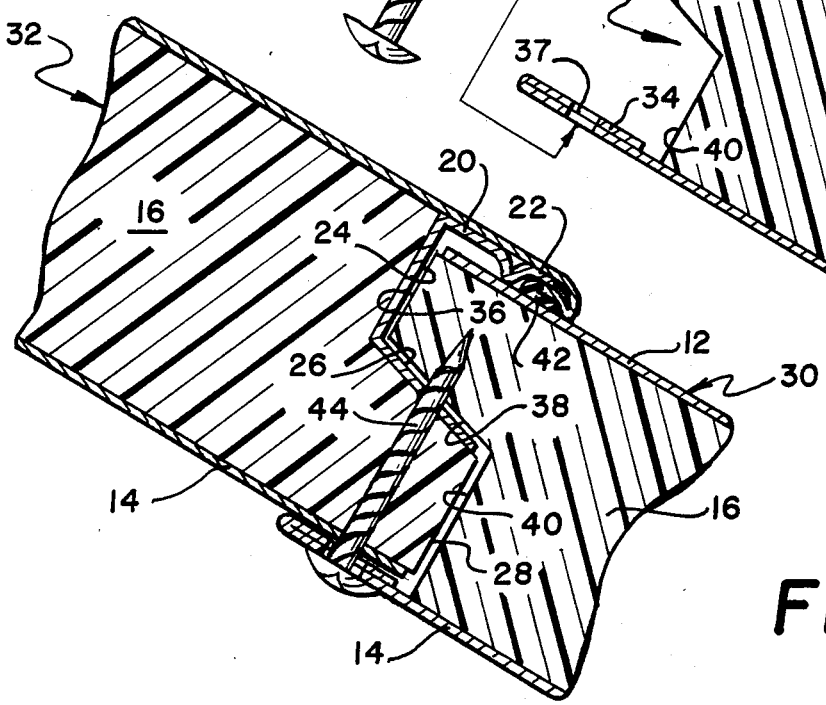
FIG. 3 is an end view of the interlocking edge portions of the roof panels shown in FIG. 2 where the two panels are joined and securely coupled together.

This can be more clearly seen from FIGS. 2 and 3 which respectively show side views of lower and upper roof panels 30, 32 displaced from one another and coupled to one another in accordance with the present invention. Since the present invention is intended for use in an inclined roof application, lower and upper roof panels 30, 32 are shown in an inclined orientation. The lower edge of the upper roof panel 32 includes a front slot 18A, immediately below which is located an extended facing surface 28. Front slot 18A and facing surface 28 extend the length of roof panel 32 and define a continuous surface on the lower edge thereof. Front slot 18A is defined by an upper extended edge 20, a recessed facing surface 24, and an oblique surface 26. Positioned on a distal portion of the upper extended edge 20 is a sealant pocket 22 in which a sealant rod, or caulk strip, 42 is positioned prior to assembly of abutting roof panels.

The upper, or rear, edge of the lower roof panel 30 includes a rear slot 18B located on a lower portion thereof. Rear slot 18B is defined by a lower extended edge 34, a recessed facing surface 40, and an oblique surface 38 of the lower roof panel 30. Positioned immediately above and continuous with the rear slot 18B is an extended facing surface 36 on the rear edge of the lower roof panel 30.

The upper and lower roof panels 32, 30 are shown in an assembled configuration in FIG. 3, wherein the forward edge of the upper roof panel 32 abuts the rear edge of the lower roof panel 30. When thus assembled, the upper extended edge 20 of the upper roof panel 32 overlaps the rear edge of the lower roof panel 30. Similarly, the lower extended edge 34 of the lower roof panel 30 overlaps the forward edge of the upper roof panel 32. In addition, the extended facing surface 36 of the lower roof panel 30 is positioned immediately adjacent the recessed facing surface 24 of the upper roof panel 32 and the extended facing surface 28 of the upper roof panel 32 is positioned immediately adjacent the recessed facing surface 40 of the lower roof panel 30. Finally, in the assembled configuration the respective oblique surfaces 26, 38 of the upper and lower roof panels 32, 30 are positioned so as to abut one another.

The lower extended edge 34 of the lower roof panel 30 includes a through hole 37 through which a screw 44 is inserted. Screw 44 is of the self-tapping type and is further inserted through the extended portion of the forward edge of the upper roof panel 32 and is threadably engaged therewith. Further rotation of self-tapping screw 44 causes it to threadably engage the extended portion of the rear edge of the lower roof panel 30. Tightening of screw 44 results in the downward displacement of the upper roof panel 32 such that its lower wall 14 abuts the inner surface of the lower extended edge 34 of the lower roof panel 30. This downward displacement of the upper roof panel 32 results in the displacement of the upper extended edge 20 of the upper roof panel 32 toward the upper wall 12 of the lower roof panel 30. This causes the compression of the sealant rod 42 positioned within the sealant groove 22 and between the respective roof panels. Thus, screw 44 not only securely couples the lower and upper roof panels 30, 32, but also provides a water-proof seal between these roof panels by drawing together in tight fitting, abutting engagement the roof panels with the compressible sealant rod 42 positioned therebetween.

There has thus been shown a roof panel construction in which abutting edges of adjacent panels are arranged in an overlapping configuration. This configuration is maintained by a plurality of screws positioned along the length of the inter-panel joint. Tightening of these screws produces a drawing together action between the abutting, overlapping roof panels resulting in the compression of a sealant rod or caulk strip positioned between the roof panels in forming a mechanically strong, waterproof roof panel coupling.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A shiplapped joint between first and second edge-abutting panels each having upper and lower faces and a core material therebetween for use in a pitched roof including said first and second panels, wherein said first panel is positioned higher on the pitched roof than the second panel, said joint comprising:

an extended edge portion of the upper face of said first panel and an extended edge portion of the lower face of said second panel wherein said respective edge portions of each of said first and second panels are mutually complementary in configuration and each overlaps the immediately adjacent, abutting portion of the other panel;

a recessed portion located on an inner edge portion of the upper face of said first panel and extending the length thereof, said recessed portion adapted to receive a sealant positioned therein; and coupling means inserted through the extended edge portion of the lower face of said second panel for engaging an overlapping edge portion of said first panel in abutting contact with a corresponding overlapping edge portion of said second panel and for displacing said second panel upward whereby said sealant is compressed in tight fitting relation between the extended edge portion of the upper face of said first panel and said overlapping edge portion of said second panel and seals said joint.

2. An inter-panel joint in accordance with claim 1 wherein the upper and lower faces of said first and second panels are comprised of sheet metal.

3. An inter-panel joint in accordance with claim 1 wherein said core material is comprised of an insulator.

4. An inter-panel joint in accordance with claim 1 wherein said insulator is comprised of rigid plastic foam.

5. An inter-panel joint in accordance with claim 1 wherein said coupling means includes a metal screw for threadably engaging an overlapping edge portion of said first panel and displacing said second panel upward.

6. An inter-panel joint in accordance with claim 5 wherein said metal screw is of the self-tapping type.

7. An inter-panel joint in accordance with claim 1 wherein said sealant includes a compressible sealant rod.

8. An inter-panel joint in accordance with claim 1 wherein said sealant includes a caulk strip.

9. An inter-panel joint in accordance with claim 1 wherein said sealant is compressed between the inner edge portion of the upper face of said first panel and the upper face of said second panel.

* * * * *

UNITED STATES PATENT AND TRADEMARK OFFICE

CERTIFICATE OF CORRECTION

PATENT NO. : 4,575,981

DATED : March 18, 1986

INVENTOR(S) : William H. Porter

It is certified that error appears in the above—identified patent and that said Letters Patent is hereby corrected as shown below:

Column 2, line 53, "inventiCon" should be -- invention --.

Column 5, line 8, "claim 1" should be -- claim 3 --.

Signed and Sealed this

*Twenty-fourth* Day of *June 1986*

[SEAL]

*Attest:*

DONALD J. QUIGG

*Attesting Officer*

*Commissioner of Patents and Trademarks*